US007493972B1

(12) United States Patent
Schmidt et al.

(10) Patent No.: US 7,493,972 B1
(45) Date of Patent: Feb. 24, 2009

(54) SUPERABRASIVE COMPACT WITH SELECTED INTERFACE AND ROTARY DRILL BIT INCLUDING SAME

(75) Inventors: Scott M. Schmidt, Draper, UT (US); Michael John Sandstrom, Highland, UT (US)

(73) Assignee: US Synthetic Corporation, Orem, UT (US)

( * ) Notice: Subject to any disclaimer, the term of this patent is extended or adjusted under 35 U.S.C. 154(b) by 182 days.

(21) Appl. No.: 11/463,452

(22) Filed: Aug. 9, 2006

(51) Int. Cl.
*E21B 10/36* (2006.01)

(52) U.S. Cl. ..... 175/432

(58) Field of Classification Search ..... 175/430, 175/432, 434

See application file for complete search history.

(56) References Cited

U.S. PATENT DOCUMENTS

| | | | | |
|---|---|---|---|---|
| 4,764,434 | A | 8/1988 | Aronsson et al. | |
| 4,997,049 | A | 3/1991 | Tank et al. | |
| 5,120,327 | A | 6/1992 | Dennis | |
| 5,355,969 | A * | 10/1994 | Hardy et al. | 175/432 |
| 5,379,854 | A | 1/1995 | Dennis | |
| 5,435,403 | A | 7/1995 | Tibbitts | |
| 5,472,376 | A | 12/1995 | Olmstead et al. | |
| 5,484,330 | A | 1/1996 | Flood et al. | |
| 5,590,728 | A | 1/1997 | Matthias et al. | |
| 5,711,702 | A | 1/1998 | Devlin | |
| 5,875,862 | A * | 3/1999 | Jurewicz et al. | 175/432 |
| 5,906,246 | A | 5/1999 | Mensa-Wilmot et al. | |
| 6,041,875 | A | 3/2000 | Rai et al. | |
| 6,068,071 | A | 5/2000 | Jurewicz | |
| 6,488,106 | B1 * | 12/2002 | Dourfaye | 175/428 |
| 6,571,891 | B1 * | 6/2003 | Smith et al. | 175/428 |
| 6,739,417 | B2 * | 5/2004 | Smith et al. | 175/432 |
| 6,962,218 | B2 * | 11/2005 | Eyre | 175/432 |
| 7,270,199 | B2 * | 9/2007 | Hall et al. | 175/432 |

* cited by examiner

*Primary Examiner*—William P Neuder
(74) *Attorney, Agent, or Firm*—Holland & Hart

(57) ABSTRACT

A superabrasive compact including a superabrasive layer bonded to a substrate along a selected interface is disclosed. In one embodiment, an interface may comprise a depression and a dividing wall, wherein the dividing wall forms at least one closed plane figure. In another embodiment, an interface may comprise a depression, a dividing wall forming at least one closed plane figure, and at least one raised feature positioned within the depression. In a further embodiment, an interface may comprise a depression formed into the substrate, the depression surrounded by a closed peripheral wall exhibiting a thickness of about 0.080 inches or less. A rotary drill bit including at least one cutting element is also disclosed.

32 Claims, 12 Drawing Sheets

SUPERABRASIVE COMPACT WITH SELECTED INTERFACE AND ROTARY DRILL BIT INCLUDING SAME

BACKGROUND

Superabrasive compacts are utilized for a variety of applications and in a corresponding variety of mechanical systems. For example, polycrystalline diamond elements are used in drilling tools (e.g., as inserts, cutting elements, gage trimmers, etc.), machining equipment, bearing apparatuses, wire drawing machinery, and in other mechanical systems. Such superabrasive compacts may be known in the art as inserts, buttons, machining tools, wear elements, and bearing elements are typically manufactured by forming a superabrasive layer on the end of a substrate (e.g., a sintered or cemented tungsten carbide substrate). As an example, polycrystalline diamond, or other suitable superabrasive material, such as cubic boron nitride, may be sintered onto the surface of a cemented carbide substrate under ultra-high pressure and ultra-high temperature to form a superabrasive compact, as described in greater detail below. In one specific example, polycrystalline diamond compacts (PDCs) have found utility as cutting elements in drill bits (e.g., roller cone drill bits and fixed cutter drill bits).

More particularly, a PDC may be employed as a subterranean cutting element mounted to a drill bit either by press-fitting, brazing, or otherwise locking the stud into a receptacle defined by the drill bit, or by brazing the cutting element directly into a preformed pocket, socket, or other receptacle formed in the subterranean drill bit. In one example, cutter pockets may be formed in the face of a matrix-type bit comprising tungsten carbide particles that are infiltrated or cast with a binder (e.g., a copper-based binder), as known in the art. Such subterranean drill bits are typically used for rock drilling and for other operations which require high abrasion resistance or wear resistance. Generally, a rotary drill bit may include a plurality of polycrystalline compact cutting elements affixed to the drill bit body.

A PDC is normally fabricated by placing a cemented carbide substrate into a container or cartridge with a layer of diamond crystals or grains positioned adjacent one surface of a substrate. A number of such cartridges may be typically loaded into an ultra-high pressure press. The substrates and adjacent diamond crystal layers are then sintered under ultra-high temperature and ultra-high pressure conditions. The ultra-high pressure and ultra-high temperature conditions cause the diamond crystals or grains to bond to one another to form polycrystalline diamond.

Because of different coefficients of thermal expansion and modulus of elasticity, residual stresses of varying magnitudes and developed within different regions of both the superabrasive layer and the substrate, may remain in the cutting element following cooling and release of pressure. These complex stresses may be concentrated near the superabrasive table/substrate interface. Depending upon the cutting element structure, the direction of any applied forces, and the particular location within the cutting element under consideration, the stresses may be either compressive, tensile, shear, or mixtures thereof. Residual stresses at the interface between the superabrasive table and substrate may result in failure of the cutting element upon cooling or during subsequent use under thermal stress and applied forces, especially with respect to large-diameter cutting elements. These manufacturing-induced stresses are complex and may undesirably place the superabrasive table of the cutting element into tension at locations within or upon the superabrasive table and/or substrate.

During drilling operations, cutting elements may be subjected to very high forces in various directions, and the superabrasive layer may fracture, delaminate, spall, or fail due to the combination of drilling-induced stresses as well as residual stresses much sooner than would be initiated by normal abrasive wear of the superabrasive layer. Because premature failure of the superabrasive layer at the superabrasive table/substrate interface may be augmented by the presence of high residual stresses in the cutting element, attempts have been made to provide PDC cutting elements which are resistant to premature failure. For instance, the use of a transition layer with material properties intermediate of those of the superabrasive table and substrate is known in the art. Also, a variety of conventional cutting element designs in which the superabrasive table/substrate interface is three dimensional (i.e., the superabrasive layer and/or substrate have portions which protrude into the other member) exists.

Thus, it would be advantageous to provide a superabrasive compact with enhanced resistance to stress-induced damage. In addition, subterranean drill bits or tools for forming a borehole in a subterranean formation including at least one such superabrasive compact would be beneficial.

SUMMARY

The present invention relates generally to a superabrasive compact including a superabrasive layer bounded to a substrate along a selected interface. The interface between the superabrasive layer and the substrate may be configured to beneficially influence the nature, magnitude, or characteristics of residual stresses within the superabrasive table and/or substrate. For example, the interface may comprise a selected three-dimensional interface between the substrate and the superabrasive layer.

In one embodiment, a superabrasive compact may comprise a superabrasive table bonded to a substrate along an interface comprising a depression and a dividing wall. Particularly, the interface may comprise a depression formed into the substrate, the depression surrounded by a peripheral wall and a dividing wall positioned within the depression, wherein the dividing wall forms at least one closed plane figure.

Another aspect of the present invention relates to a superabrasive compact comprising a superabrasive table bonded to a substrate along an interface. Specifically, the interface may comprise a depression formed into the substrate, the depression surrounded by a peripheral wall. In addition, a dividing wall may be positioned within the depression, the dividing wall forming at least one closed plane figure. Further, at least one raised feature may be positioned within the depression. A further embodiment of the present invention relates to a superabrasive compact comprising a superabrasive table bonded to a substrate along an interface. Such a superabrasive compact may comprise a depression formed into the substrate, the depression surrounded by a closed peripheral wall, wherein the peripheral wall exhibits a thickness of about 0.080 inches or less.

The present invention further relates to a drill bit cutting element having a selected superabrasive layer/substrate interface encompassed by any of the embodiments described herein. For example, in one embodiment, a rotary drill bit for forming a borehole in a subterranean formation may comprise a bit body and at least one cutting element coupled to the bit body. In further detail, the at least one cutting element may comprise a substrate having a superabrasive layer of superabrasive material bonded to an interfacial surface of the substrate wherein an interface between the substrate and the superabrasive layer comprises a depression formed into the substrate, the depression surrounded by a peripheral wall. Further, a dividing wall may be positioned within the depression, wherein the dividing wall forms at least one closed plane figure.

The present invention generally relates to any tool for drilling a borehole in a subterranean formation including at least one cutting element according to the present invention. Particularly, the present invention contemplates that any borehole forming tool may include at least one cutting element according to the present invention. As used herein, the term "rotary drill bit" includes and encompasses full-hole bits, core bits, roller-cone bits, fixed-cutter bits, eccentric bits, bicenter bits, reamers, reamer wings, or other earth boring tools as known in the art.

Features from any of the above mentioned embodiments may be used in combination with one another, without limitation. In addition, other features and advantages of the instant disclosure will become apparent to those of ordinary skill in the art through consideration of the ensuing description, the accompanying drawings, and the appended claims.

BRIEF DESCRIPTION OF THE DRAWINGS

Further features of the subject matter of the instant disclosure, its nature, and various advantages will be more apparent from the following detailed description and the accompanying drawings, which illustrate various exemplary embodiments, are representations, and are not necessarily drawn to scale, wherein.

DETAILED DESCRIPTION

The present invention relates generally to a superabrasive compact comprising a superabrasive layer or table bonded to a substrate. More specifically, a selected three-dimensional interface may be formed between the superabrasive layer and the substrate. In one embodiment, the interface may comprise a depression formed into one end surface of the substrate. Such a depression may be formed over a majority of the end surface area and may form a closed peripheral wall extending proximate the periphery of the substrate. Optionally, at least one raised feature may extend from a base surface of the depression. In one embodiment, an upper surface of the at least one raised feature may extend beyond an upper surface of the closed peripheral wall.

Figure 1:
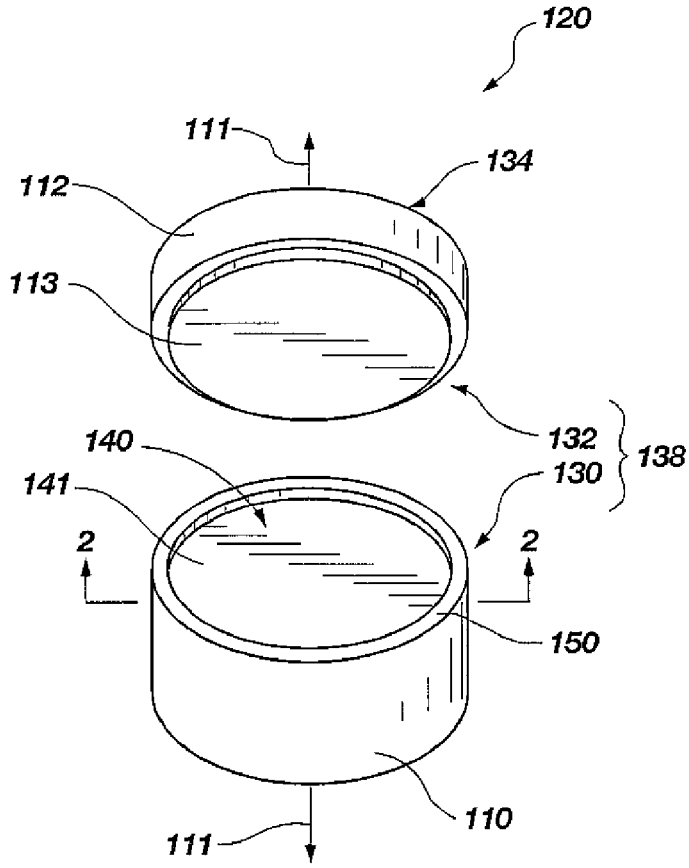
FIG. 1 shows an exploded perspective view of a superabrasive compact according to the present invention.
Figure 2:
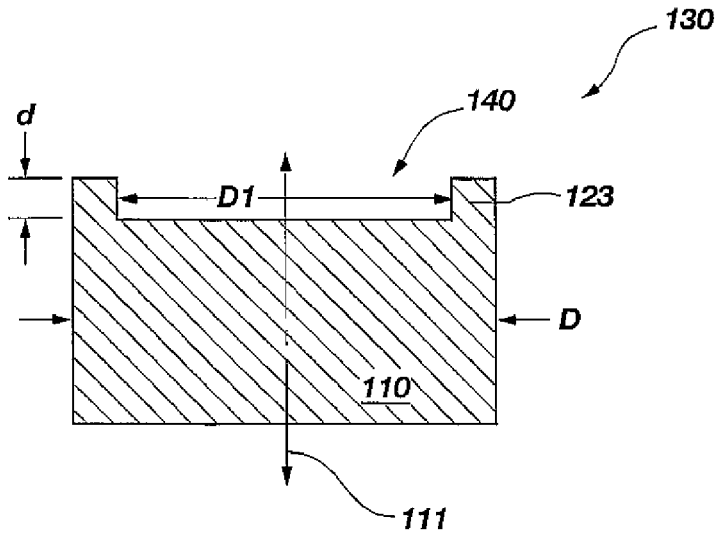
FIG. 2 shows a schematic side cross-sectional view of the superabrasive compact shown in FIG. 1.

In one aspect of the present invention, an interface between a superabrasive table and a substrate may comprise a depression formed into an end surface of the substrate. For example, as shown in FIGS. 1-2, in an exploded perspective view and a schematic, side cross-sectional view, a superabrasive compact 120 (e.g, a polycrystalline diamond compact) may comprise a selected three-dimensional interface 138 between the superabrasive table 112 or volume and a substrate 110. The interface 138 between the superabrasive layer or table 120 and the substrate 110 may be configured to develop a beneficial residual stress distribution within at least one or both of the superabrasive table 120 and the substrate 110.

As depicted in FIGS. 1-2, an exemplary superabrasive compact 120 may be generally cylindrical about a central or longitudinal axis 111. Superabrasive compact 120 may comprise a superabrasive table 112 with an exposed surface 134 (e.g., a cutting face, if superabrasive compact 120 is employed as a cutting element) and an interfacial surface 132, generally including complementary shaped protrusion 113. Such a superabrasive compact 120 may be able to withstand relatively high applied drilling forces because of a beneficial stress state and relatively high strength of mutual affixation between the superabrasive table 112 and substrate 110 provided by the interface 138. The superabrasive table 120 may comprise diamond (e.g., polycrystalline diamond), a diamond material (e.g., diamond formed by chemical vapor deposition, etc.), or any superabrasive material (e.g., cubic boron nitride, silicon carbide, etc.), as known in the art. Substrate 110 may be typically formed of a hard material such as so-called "carbide," for instance, a cemented tungsten carbide or any other relatively hard material known in the art.

As one of ordinary skill in the art will understand, the interfacial surfaces 132 and 130, when taken together, are considered to be the interface 138 between superabrasive table 120 and substrate 110. The interface 138 may be generally nonplanar, (i.e., exhibiting three-dimensional characteristics) and may include portions of superabrasive table 120 which extend or protrude into and are accommodated by substrate 110, and vice versa, since each comprises complementary features in relation to the other. In other words, any irregularity, or three-dimensional configuration, at the interface 138 may be looked upon as both a projection, or protrusion, of the substrate 110 into the superabrasive table 120 and the inverse, (i.e., a protrusion or projection), of the superabrasive table 120 into the substrate 110. Therefore, if one defines an interfacial surface of a superabrasive table or a substrate, the other interfacial surface of the substrate or the superabrasive table, respectively is, at least generally, simply the inverse, complementary shape of the defined interfacial surface.

In one embodiment, interfacial surface 130 of substrate 110 may comprise a depression 140 formed into an end surface of substrate 110. Thus, depression 140 may be defined, in part, by base surface 141 and may be surrounded by peripheral wall 150. In one embodiment, a diameter D of substrate 110 may be about 0.529 inches and a diameter D1 of depression 140 may be between about 0.200 and about 0.450 inches (e.g., about 0.409 inches). Thus, in one embodiment, depression 140 may be formed over between about 50-75% of the cross-sectional area of an end of substrate 110. Further, in one embodiment, peripheral wall 140 may exhibit (i.e., extend from base surface 141 of substrate 110) a height or distance d of at least about 0.020 inches. In another embodiment, depression 140 may extend into substrate 110 a height or distance d of about 0.200 inches.

In another aspect of the present invention, optionally, a closed plane figure may be positioned generally within the depression formed into an end of a substrate. More particularly, a dividing wall may be positioned generally within the depression and may follow a selected path. In one embodiment, a dividing wall may form a closed plane figure. The phrase "closed plane figure," as used herein, refers to any closed shape or outline (e.g., a circle, a polygon, a star-shaped outline, a figure eight, etc.) as known in the art. In one embodiment, a closed plane figure may be generally circular, generally oval, generally elliptical, or any other smoothly-transitioning arcuate closed plane figure as known in the art, without limitation. In another embodiment, a closed plane figure may form a polygon. Optionally, the dividing wall may extend from the base surface and may separate two regions of the base surface. In another embodiment, a lower surface surrounded by the dividing wall may be uneven within (e.g. above or below) base surface 141 of depression 140.

Figure 3:
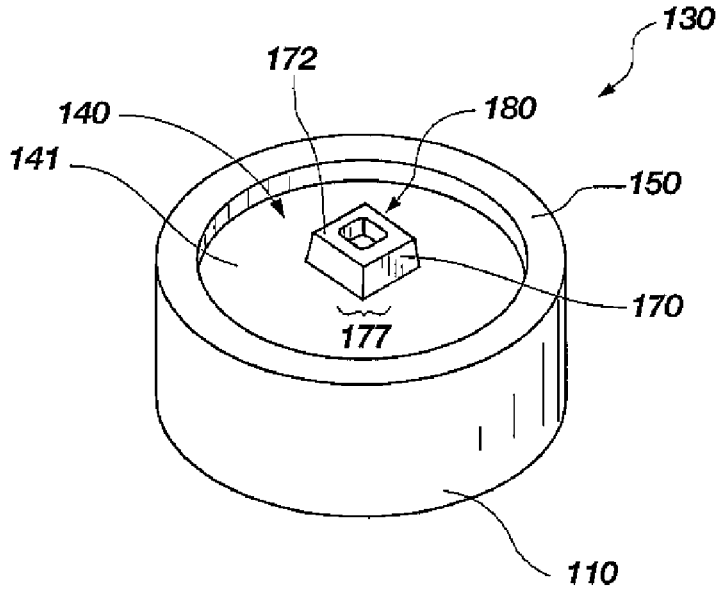
FIG. 3 shows a perspective view of one embodiment of a substrate including a closed plane figure.

In one example, FIG. 3 shows a perspective view of one embodiment of a substrate 110 including an interfacial surface 130 comprising a depression 140 base surface 141 and a dividing wall 170 forming a generally square-shaped closed plane figure 180. As shown in FIG. 3, dividing wall 170 may include a substantially planar upper surface 172. In another embodiment, upper surface 172 may exhibit a nonplanar, selected topography. Further, as shown in FIG. 3, closed plane figure 180 may include substantially cubic vertex regions 177. In addition, optionally, dividing wall 170 may taper (e.g, expand or shrink in relation to increasing distance from base surface 141), if desired. In addition, closed plane figure 180 may exhibit a selected size. In one embodiment, closed plane figure 180 may be generally square-shaped and may have a side length of about 0.110 inches. In another embodiment, closed plane figure 180 may be generally rectangular, generally parallelogram, or generally polygonal, if desired.

Figure 4:
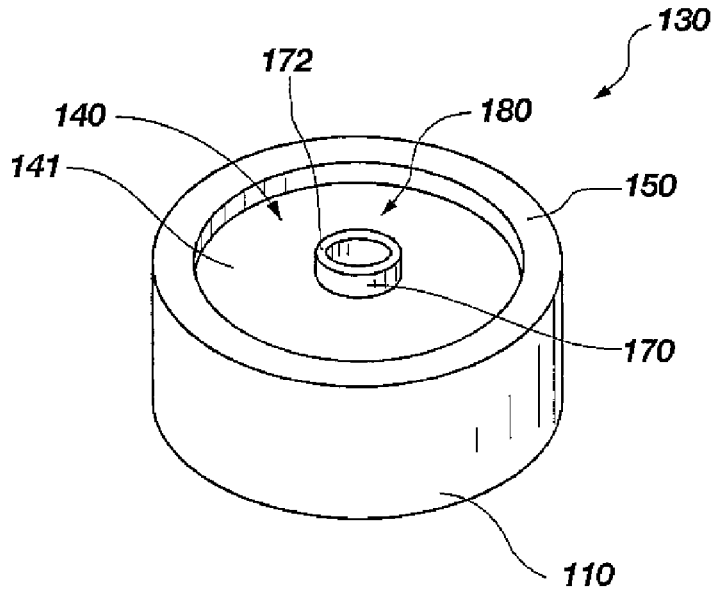
FIG. 4 shows a perspective view of another embodiment of a substrate including a closed plane figure.

In another example, FIG. 4 shows a perspective view of one embodiment of a substrate 110 including an interfacial surface 130 comprising a depression 140 forming base surface 141 as described above and a dividing wall 170 forming a generally circular closed plane figure 180. One of ordinary skill in the art will appreciate, in other embodiments, closed plane figure 180 may be generally ovoid, generally oval, or generally elliptical, without limitation. As shown in FIG. 4, dividing wall 170 may include a substantially planar upper surface 172. However, in other embodiments, upper surface 172 may exhibit a nonplanar, selected topography. Further, as mentioned above, optionally, dividing wall 170 may taper (e.g., expand or shrink in relation to increasing distance from base surface 141), if desired. In addition, closed plane figure 180 may exhibit a selected size. In one embodiment, closed plane figure 180 may exhibit an inner diameter of about 0.070 inches and an outer diameter of about 0.120 inches.

Figure 5:
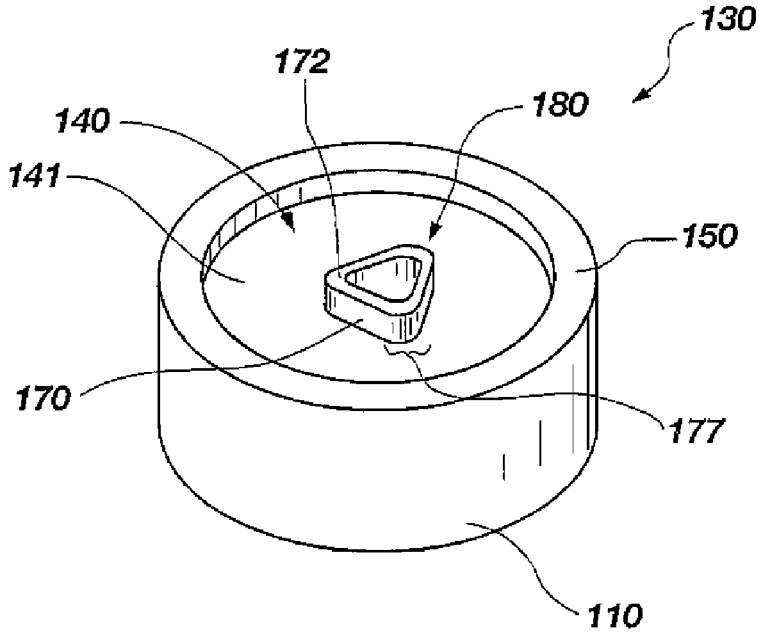
FIG. 5 shows a perspective view of yet an additional embodiment of a substrate including a closed plane figure.

As mentioned above, any closed plane figure (e.g., a dividing wall following at least one curve, at least one linear path, or combinations of the foregoing, without limitation) as known in the art may be formed by a dividing wall. For instance, in a further example, FIG. 5 shows a perspective view of one embodiment of a substrate 110 including an interfacial surface 130 comprising a depression 140 forming base surface 141 as described above and a dividing wall 170 forming a generally triangular closed plane figure 180. As shown in FIG. 5, dividing wall 170 may include a substantially planar upper surface 172 or, optionally, in other embodiments, upper surface 172 may exhibit a nonplanar, selected topography. One of ordinary skill in the art will appreciate that a generally triangular closed plane figure 180 may exhibit partially rounded vertex regions 177, if desired, or may exhibit "sharp" vertex regions in other embodiments. Optionally, dividing wall 170 may taper (e.g., expand or shrink in relation to increasing distance from base surface 141), if desired. In addition, closed plane figure 180 may exhibit a selected size.

Figure 6:
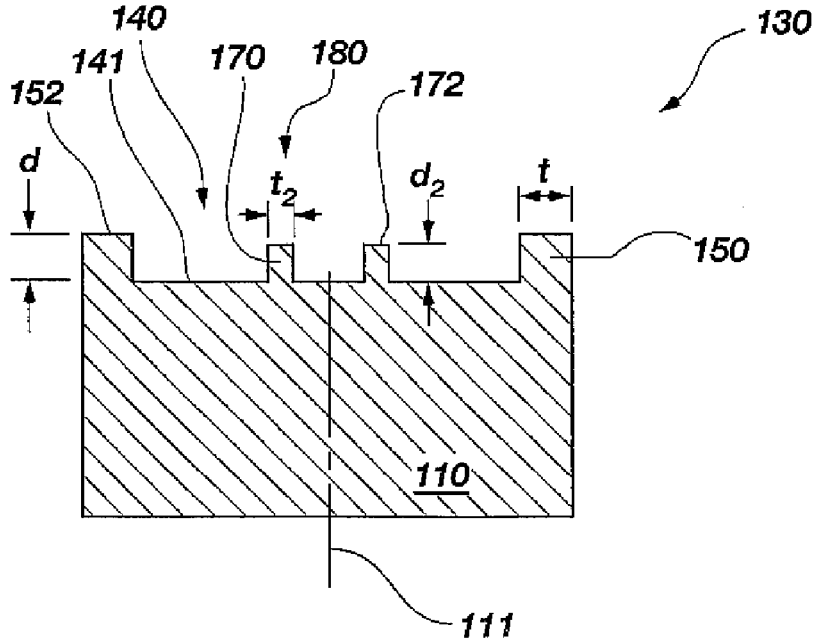
FIG. 6 shows a schematic, side cross-sectional view of one embodiment of a substrate as shown in FIGS. 3-5.
Figure 7:
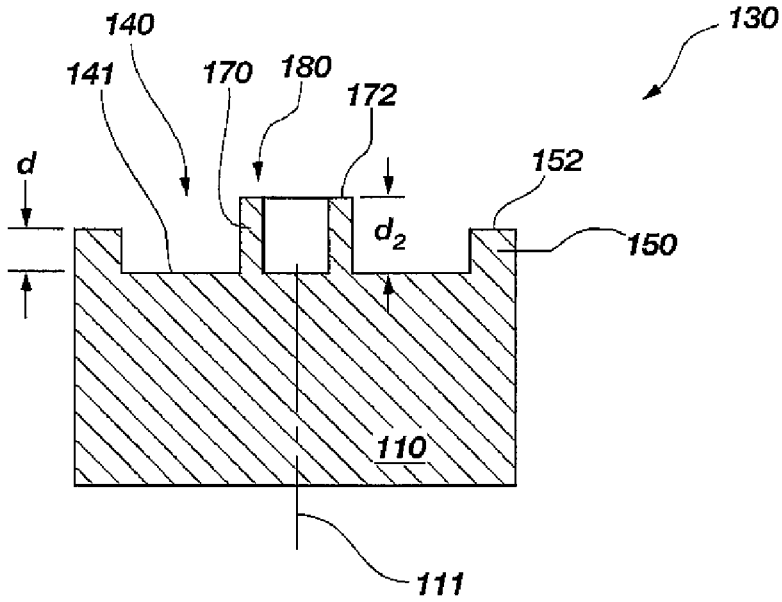
FIG. 7 shows a schematic side cross-sectional view of another embodiment of a substrate as shown in FIGS. 3-5.

Generally, the present invention contemplates that an upper surface of a dividing wall forming a closed plane figure may be positioned below, above, or substantially even with an upper surface of a peripheral wall. For example, FIG. 6 shows a schematic, side cross-sectional view of a substrate 110 including a closed plane figure 180. Closed plane figure 180 may comprise any of the above-described embodiments, without limitation. As shown in FIG. 6, upper surface 172 of closed plane figure 180 may be positioned closer to base surface 141 than upper surface 152 of peripheral wall 150. Put another way, a magnitude of height or distance $d_2$ between base surface 141 and upper surface 172 of closed plane figure 180 may be less than a magnitude of height or distance d between base surface 141 and upper surface 152 of peripheral wall 150. As further illustrated by FIG. 6, peripheral wall 150 may exhibit a selected thickness t. In one embodiment, thickness t may be about 0.015 inches to about 0.040 inches. Further, closed plane figure 180 may exhibit a selected thickness $t_2$. In one embodiment, $t_2$ may be about 0.015 inches to about 0.040 inches In another embodiment, an upper surface 172 of dividing wall 170 may extend beyond upper surface 141 of peripheral wall 140. For example, FIG. 7 shows a schematic, side cross-sectional view of a substrate 110 including a closed plane figure 180. Generally, substrate 110 may be as described above in relation to FIG. 6. However, as shown in FIG. 7, upper surface 172 of closed plane figure 180 may be positioned farther from base surface 141 than upper surface 152 of peripheral wall 150. Put another way, a magnitude of height or distance $d_2$ between base surface 141 and upper surface 172 of closed plane figure 180 may exceed a magnitude of height or distance d between base surface 141 and upper surface 152 of peripheral wall 150.

Figure 8:
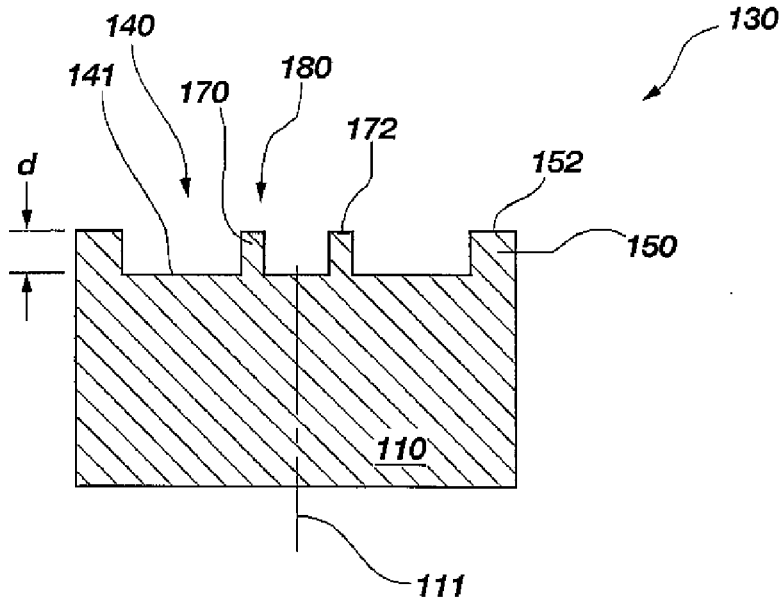
FIG. 8 shows a schematic side cross-sectional view of yet an additional embodiment of a substrate as shown in FIGS. 3-5.

In yet a further embodiment, an upper surface 172 of dividing wall 170 may be substantially even with upper surface 141 of peripheral wall 140. For example, FIG. 8 shows a schematic, side cross-sectional view of a substrate 110 including a closed plane figure 180. Generally, substrate 110 may be as described above in relation to FIG. 6. However, as shown in FIG. 8, upper surface 172 of closed plane figure 180 may be positioned at a distance from base surface 141 that is substantially equal to a distance between upper surface 152 of peripheral wall 150 and base surface 141. Put another way, a magnitude of height or distance $d_2$ between base surface 141 and upper surface 172 of closed plane figure 180 may be substantially equal to a magnitude of height or distance d between base surface 141 and upper surface 152 of peripheral wall 150. In one embodiment, distances d and/or $d_2$ may be between about 0.005 inches and about 0.250 inches.

Figure 9:
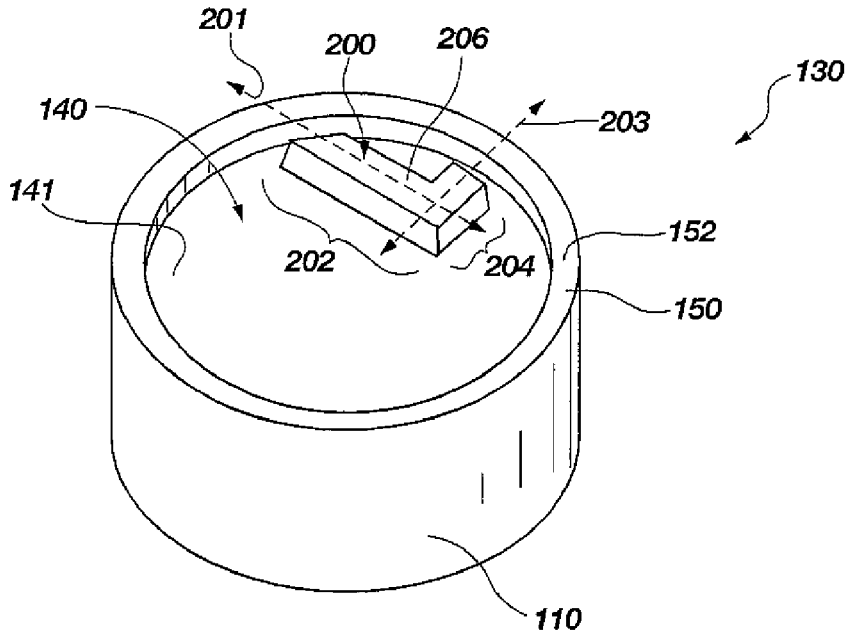
FIG. 9 shows a perspective view of one embodiment of a substrate including at least one raised feature.
Figure 10:
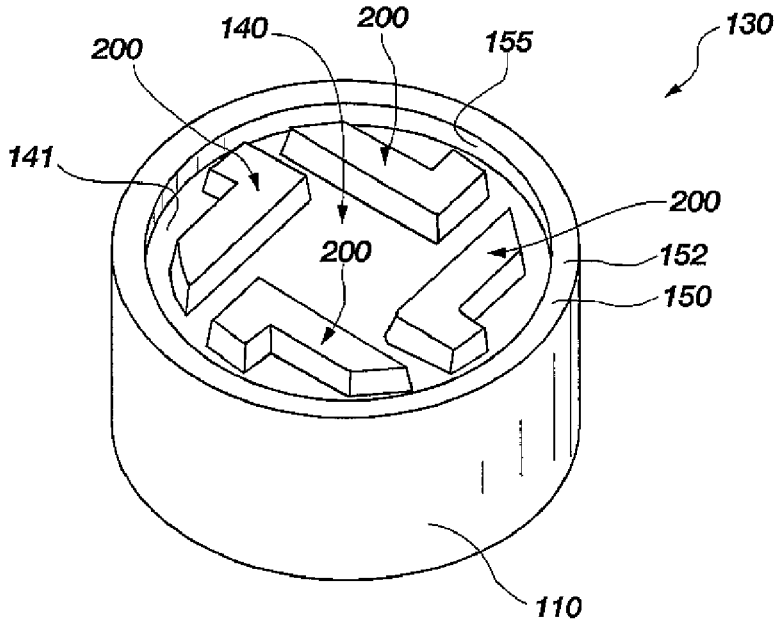
FIG. 10 shows a perspective view of one embodiment of a substrate including a plurality of raised features.

In a further aspect of the present invention, at least one raised feature may be positioned within a depression formed into a substrate. In one embodiment, a raised feature may comprise a two leg sections. Optionally, the two leg sections of the raised feature may be substantially perpendicular to one another. For example, FIG. 9 shows a substrate 110 including an interfacial surface 130 comprising a peripheral wall 150 surrounding a depression 140 and a base surface 141, generally as described above. In addition, as shown in FIG. 9, a raised feature 200 may be positioned generally within depression 140. More specifically, in one embodiment, raised feature 200 may comprise a first leg section 202 and a second leg section 204. As shown in FIG. 9, each of leg sections 202, 204 may extend from a junction toward peripheral wall 150. In one embodiment, leg sections 202, 204 may be contiguous with (i.e., touching) peripheral wall 150. In another embodiment, as shown in FIG. 10, leg sections 202, 204 may be adjacent to, but separated from, an inner surface 155 of peripheral wall 150. Optionally, as shown in FIG. 9, the first leg section 202 and the second leg section 204 may be generally perpendicular to one another. Put another way, first leg section 202 may extend generally along a first reference axis 201, while second leg section 204 may extend generally along a second reference axis 203, wherein first reference axis 201 is generally perpendicular to second reference axis 203.

In another embodiment, a plurality of raised features may be positioned generally within a depression formed into a substrate. More particularly, in one embodiment, a plurality of substantially identical raised features may be arranged in a selected configuration. For example, a plurality of substantially identical raised features may be positioned upon a selected reference path or shape about a central axis (e.g., along a reference circle or other shape) of a substrate. For example, FIG. 10 shows a perspective view of a substrate 110 including an interfacial surface 103 comprising a depression 140 and a plurality of raised features 200 (as described above in relation to FIG. 9) positioned in a circumferential pattern generally equidistantly from one another. Put another way, each of the plurality of raised features 200 may be positioned as if rotated about a selected axis (e.g., positioned at 0°, 90°, 180°, and 270°). Optionally, a selected axis may be aligned with a longitudinal axis of the substrate 110. Such a configuration may, when a superabrasive table is bonded to the substrate 110, promote regions of symmetry of residual stress fields in the substrate 110, the superabrasive table, or both. In another embodiment, a plurality of raised features 200 may be arranged in any selected pattern or configuration, without limitation.

Figure 11:
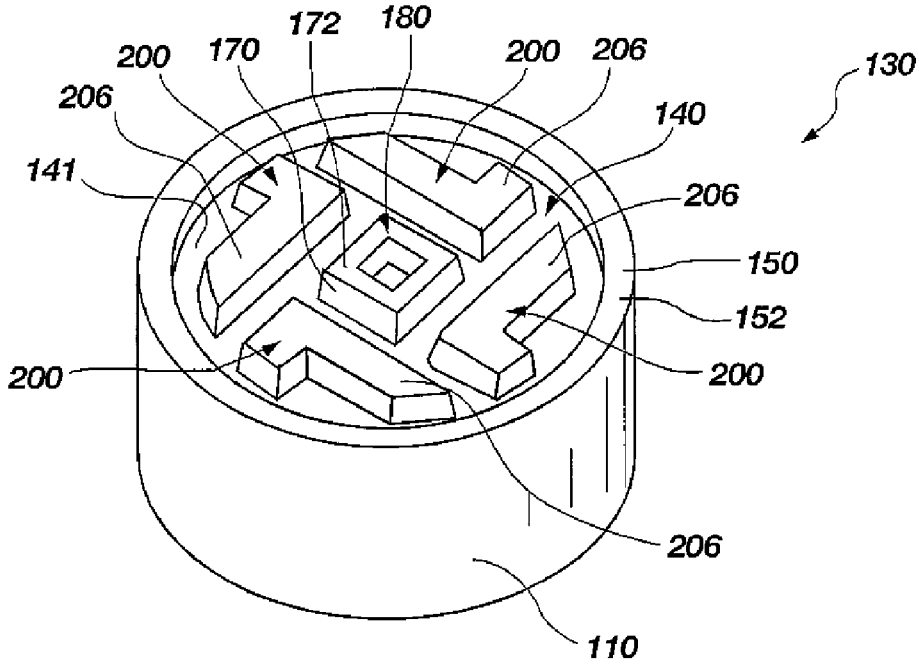
FIG. 11 shows a perspective view of one embodiment of a substrate including a closed plane figure and a plurality of raised features.

The present invention further contemplates that one or more structural aspects of the substrate embodiments described above may be modified and/or combined with one another. For example, a substrate may comprise a depression, a dividing wall forming a closed plane figure, and at least one raised feature extending from the base surface of the depression. For example, FIG. 11 shows a perspective view of one embodiment of a substrate 110 including an interface 130 comprising a peripheral wall 150 surrounding a depression 140 and base surface 141. In addition, substrate 110 includes a dividing wall 170 forming a generally square-shaped closed plane figure 180 (as described above with reference to FIGS. 1-3 and 6-8). Further, as shown in FIG. 11, a plurality of raised features 200 (as described above with reference to FIGS. 9 and 10) are positioned between closed plane figure 180 and peripheral wall 150. Such a configuration may provide a desirable residual stress field when a superabrasive table is bonded to the interfacial surface 130 of substrate 110.

Optionally, upper surfaces 20 of raised features 200, respectively, may be positioned below, above, or substantially even with (e.g. coplanar exhibiting a substantially identical non-planar topography) an upper surface 152 of peripheral wall 150. For example, each of upper surfaces 206 of raised features 200 may be positioned closer to base surface 141 than upper surface 152 of peripheral wall 150. Put another way, a magnitude of distance between base surface 141 and each of upper surfaces 206 of raised features 200, respectively, may be less than a magnitude of distance between base surface 141 and upper surface 152 of peripheral wall 150. As a further optional embodiment, as discussed above, an upper surface 172 of dividing wall 170 forming a closed plane figure 180 may be positioned below, above, or substantially even with an upper surface 152 of peripheral wall 150. For example, as shown in FIG. 11, upper surface 172 of closed plane figure 180 may be positioned closer to base surface 141 than upper surface 152 of peripheral wall 150. Put another way, a magnitude of distance between base surface 141 and upper surface 172 of closed plane figure 180 may be less than a magnitude of distance between base surface 141 and upper surface 152 of peripheral wall 150. In another embodiment, upper surfaces 206 of raised features 200 may be substantially even with an upper surface 172 of closed plane figure 180.

Figure 12:
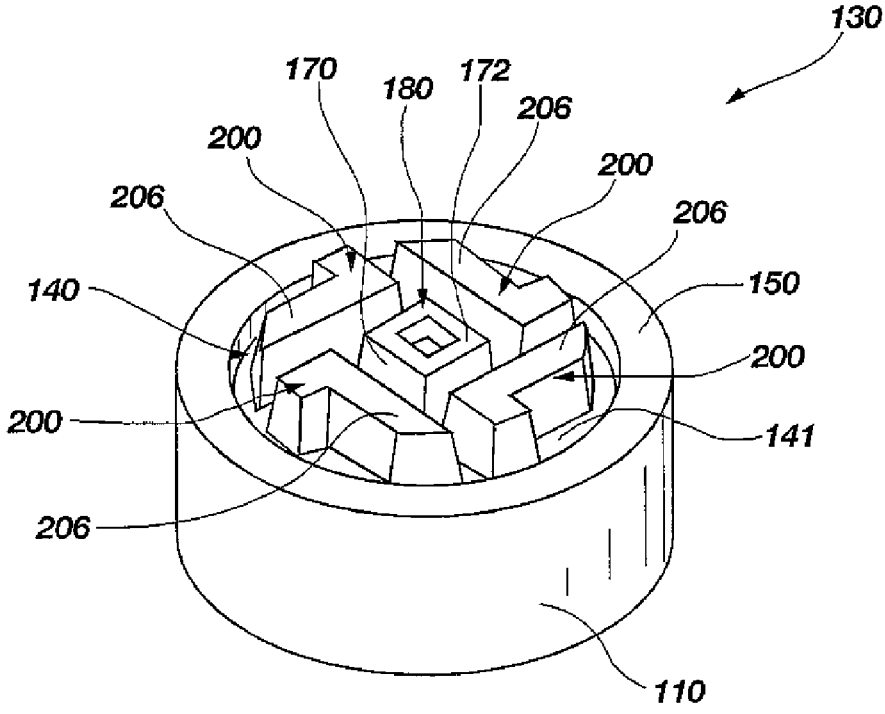
FIG. 12 shows a perspective view of another embodiment of a substrate including a closed plane figure and a plurality of raised features.

FIG. 12 shows a perspective view of a substrate 110 including an interfacial surface 130, wherein each of upper surfaces 206 of raised features 200 are positioned farther from base surface 141 than upper surface 152 of peripheral wall 150. Put another way, a magnitude of distance between base surface 141 each of upper surfaces 206 of raised features 200, respectively, may be greater than a magnitude of distance between base surface 141 and upper surface 152 of peripheral wall 150. As a further optional embodiment, as discussed above, an upper surface 172 of dividing wall 170 forming a closed plane figure 180 may extend beyond an upper surface 152 of peripheral wall 150. For example, as shown in FIG. 12, upper surface 172 of closed plane figure 180 may be positioned farther from base surface 141 than upper surface 152 of peripheral wall 150. Put another way, a magnitude of distance between base surface 141 and upper surface 172 of closed plane figure 180 may be greater than a magnitude of distance between base surface 141 and upper surface 152 of peripheral wall 150. In one embodiment, upper surfaces 206 of raised features 200 may be substantially even with an upper surface 172 of closed plane figure 180. In another embodiment, upper surfaces 206 of raised features 200, an upper surface 172 of closed plane figure 180, and upper surface 152 of peripheral wall 150 may be substantially even with one another.

Figure 13:
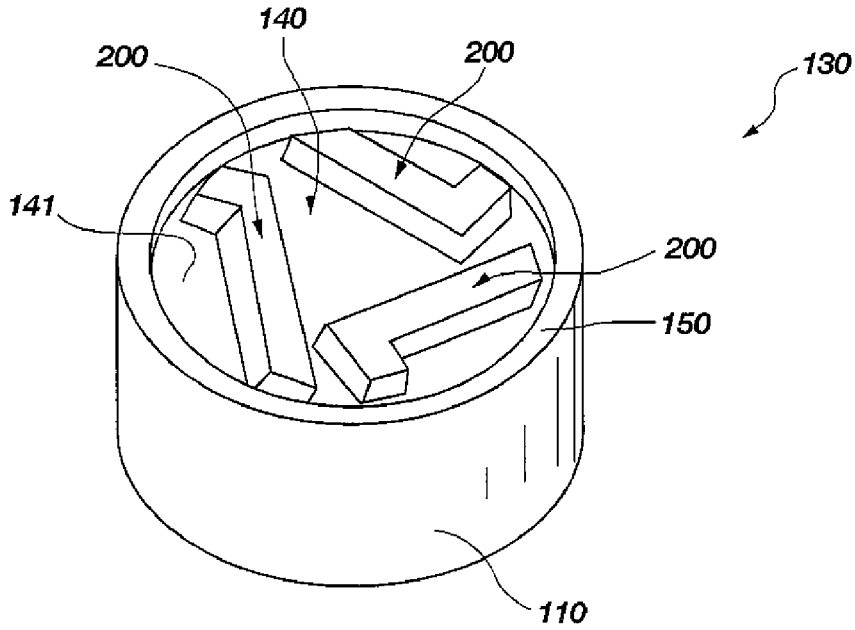
FIG. 13 shows a perspective view of another embodiment of a substrate including a plurality of raised features.
Figure 14:
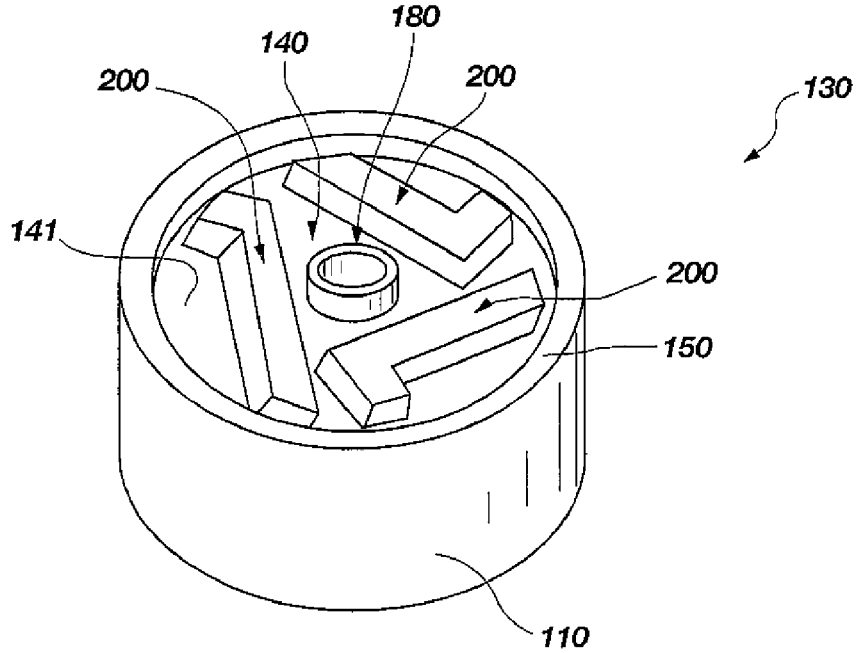
FIG. 14 shows a perspective view of a further embodiment of a substrate including a closed plane figure and a plurality of raised features.

FIG. 13 shows a perspective view of a substrate 110 including an interfacial surface 130 comprising a plurality of raised features 200 (as described above with reference to FIG. 9) positioned generally within a depression 140. As shown in FIG. 13, in one embodiment, the plurality of raised features 200 may be substantially identical and may be arranged in a selected configuration. For example, a plurality of substantially identical raised features 200 may be selectively positioned about a central axis (e.g., along a reference circle or other shape) of substrate 110. More specifically, raised features 200 may be positioned in a circumferential pattern generally equidistantly from one another. Put another way, each of the plurality of raised features 200 may be positioned as if rotated about a selected axis (e.g., positioned at 0°, 120°, and 240°). Optionally, such a selected axis may be aligned with a longitudinal axis of the substrate 110. Such a configuration may, when a superabrasive table is bonded to the substrate 110, promote regions of symmetry of residual stress fields in the substrate 110, the superabrasive table, or both. Such a configuration may form a generally triangular central region of base surface 141 within depression 140 generally bounded by the raised features 200. In another embodiment, a plurality of raised features 200 may be arranged in any selected pattern or configuration, without limitation. Further, optionally, a closed plane figure may be positioned adjacent to raised features 200. For example, any closed plane figure disclosed above (e.g., generally square, generally circular, generally triangular) may be positioned adjacent to raised features 200.

Figure 15:
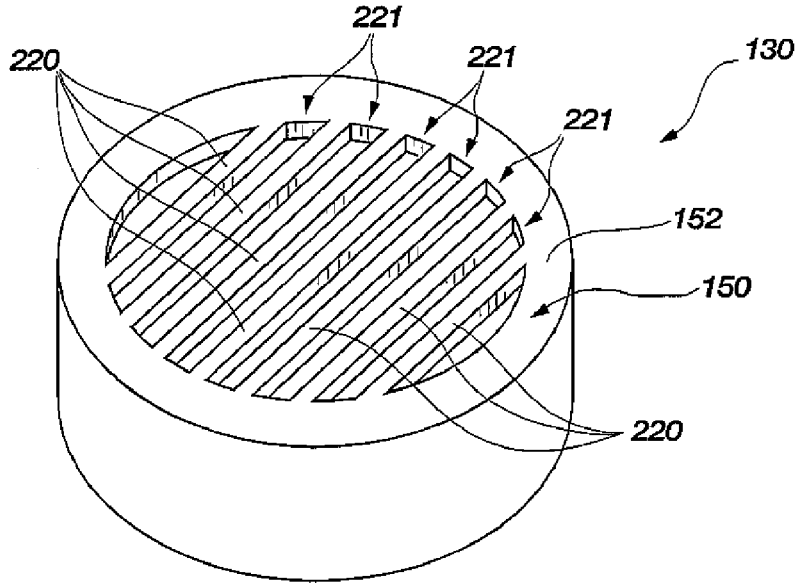
FIG. 15 shows a perspective view of a yet additional further embodiment of a substrate including a peripheral wall and a plurality of elongated walls extending generally within a depression.

The present invention also contemplates additional embodiments of substrates (and the associated superabrasive compacts formed therewith, respectively) including a peripheral wall. For example, FIG. 15 shows a perspective view of one embodiment of a substrate 110 including a peripheral wall 150. More specifically, as shown in FIG. 15, a plurality of elongated walls 220 may extend across depression 140. Explaining further, elongated channels 221 may be positioned between adjacent elongated walls 220. Thus, in one embodiment (i.e., where depression 140 and peripheral wall 150 are substantially circular), each of elongated walls 220 may form a chord across peripheral wall 150. Further, in one embodiment, an upper surface of each of elongated walls 220 may be coplanar with upper surface 152 of peripheral wall 150. In other embodiments, an upper surface of each of elongated walls 220 may be above or below upper surface 152 of peripheral wall 150 (i.e., a discontinuity or step may be formed between elongated walls 220 and peripheral wall 150). Further, as shown in FIG. 15, each of elongated walls 220 may be substantially parallel to one another. In other embodiments, one or more elongated walls may extend between different regions of peripheral wall 150 and may be nonparallel with one another or may intersect with one another, without limitation.

Figure 16:
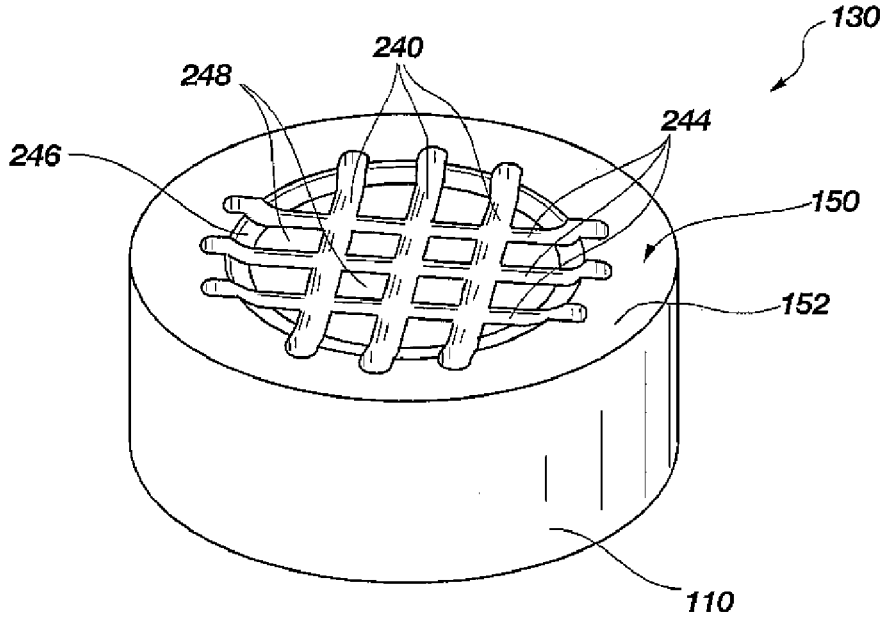
FIG. 16 shows a perspective view of another embodiment of a substrate including a plurality of channels.
Figure 17:
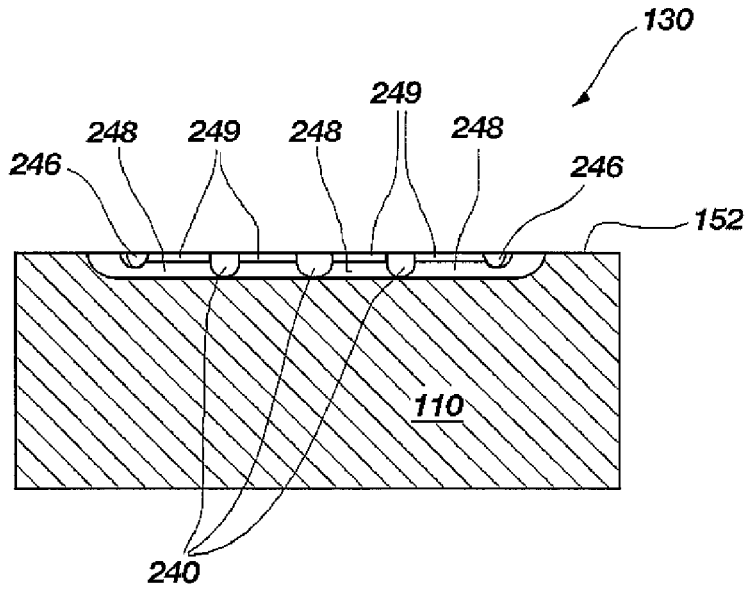
FIG. 17 shows a schematic, side cross-sectional view of the substrate shown in FIG. 16.

In a her aspect of the present invention, a substrate may include a plurality of intersecting channels. For example, FIG. 16 shows a perspective view of one embodiment of a substrate 110 including a peripheral wall 150 defined by circumferentially extending channel 246. In addition, as shown in FIG. 16, a first plurality of substantially parallel channels 240 extend generally across circumferentially extending channel 246. Further, a second plurality of substantially parallel channels 244 extend generally within circumferentially extending channel 246. In one embodiment, each end of each of channels 240 and 244 may extend beyond circumferentially extending channel 246. In addition, as shown in FIG. 16, at least some of the first plurality of substantially parallel channels 240 may intersect with at least some of the second plurality of substantially parallel channels 244 to form a plurality of island regions 248. Optionally, the first plurality of substantially parallel channels 240 may be substantially perpendicular to the second plurality of substantially parallel channels 244. In one embodiment, an upper surface of each of island regions 248 may be coplanar with upper surface 152 of peripheral wall 150. In other embodiments, an upper surface of one or more of island regions 248 may be above or below upper surface 152 of peripheral wall 150. More particularly, for example, FIG. 17 shows a schematic, side cross-sectional view of the substrate 110 shown in FIG. 16. As shown in FIG. 17, an upper surface 249 of each of island regions 248 may be below (i.e., in a direction toward or into substrate 110) upper surface 152 of peripheral wall 150. In addition, in the embodiment shown in FIG. 17, the first plurality of substantially parallel channels 240 (and, optionally the second plurality of substantially parallel channels 244) may exhibit a selected depth that exceeds a selected depth of the circumferentially extending channel 246.

Figure 18:
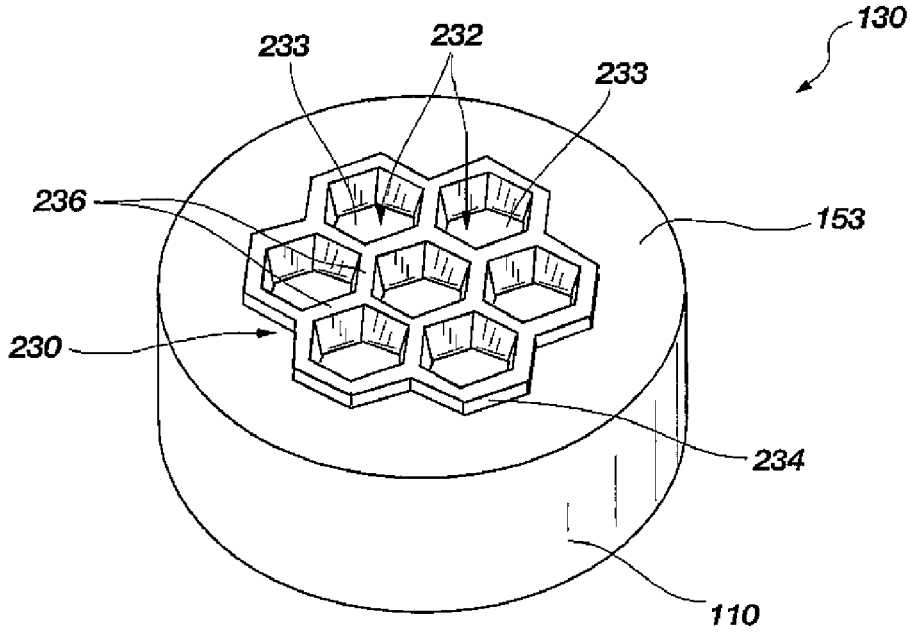
FIG. 18 shows a perspective view of one embodiment of a substrate including a hexagonal structure.

In another aspect of the present invention, a substrate may include a peripheral wall comprising a honeycomb structure. For example, FIG. 18 shows a substrate 110 including an interfacial surface 130 comprising a honeycomb structure 230. More particularly, honeycomb structure 230 may comprise a peripheral hexagonal wall 234, lower surfaces 233, and a plurality of inner hexagonal walls 236. Thus, peripheral hexagonal wall 234, lower surfaces 233, and a plurality of inner hexagonal walls 236 may define hexagonal recesses 232. In one embodiment, lower surfaces 233 of hexagonal recesses 232 are positioned below (i.e., into the substrate 110) or substantially even with (i.e., coplanar, in one embodiment) flange surface 153. Thus, peripheral hexagonal wall 234 may define a recess (i.e., collective lower surfaces 233 of hexagonal recesses 232), wherein inner hexagonal walls 236 separate the recess into hexagonal recesses 232. Such a configuration may provide a compact and effective structure for increasing an amount of surface area along an interface between substrate 110 and a superabrasive table affixed to substrate 110.

Thus, generally, the present invention contemplates that a volume or table of superabrasive material (e.g., polycrystalline diamond) may be formed upon a substrate according to the present invention to form a superabrasive compact according to the present invention. For example, an unconsolidated superabrasive material (e.g., diamond, boron nitride, etc.) may be positioned adjacent to a substrate (e.g., a substrate comprising cobalt-cemented tungsten carbide) and subjected to a HPHT sintering process. Such a sintering process may produce a coherent skeleton or sintered structure of superabrasive material (e.g., polycrystalline diamond) formed upon and bonded to the substrate. Any substrate known in the art may be utilized, such as a substrate comprising at least one of the following materials: titanium carbide, niobium carbide, tantalum carbide, vanadium carbide, iron, and nickel, without limitation. One of ordinary skill in the art will also understand that a superabrasive compact (e.g., polycrystalline diamond compact) may be utilized in many applications. For instance, wire dies, bearings, artificial joints, cutting elements, and heat sinks may include at least one superabrasive compact. Thus, the present invention contemplates that any of the embodiments encompassed by the above-discussion or variants encompassed thereby may be employed for forming a superabrasive compact.

Figure 19:
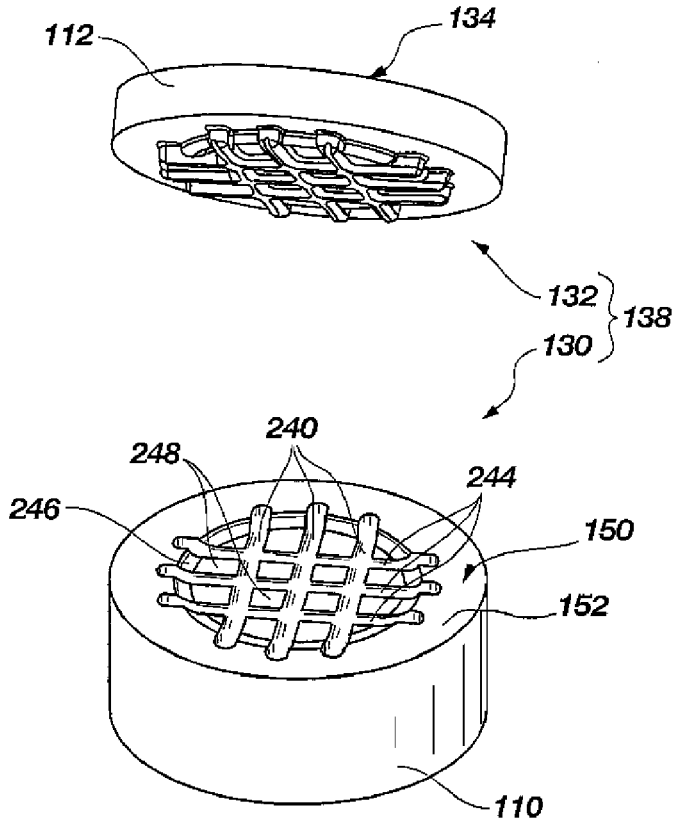
FIG. 19 shows an perspective view of a exploded perspective view of a superabrasive compact according to the present invention.

For example, for illustration purposes, FIG. 19 shows an exploded perspective view of a superabrasive compact 120. More particularly, superabrasive compact 120 may comprise a superabrasive table 112 forming an exposed surface 134 (e.g., a cutting face, if superabrasive compact 120 is employed as a cutting element) and an interfacial surface 132, (generally including complementary shaped topography with respect to interfacial surface 130) which is bonded to interfacial surface 130 of substrate 110. Such a superabrasive compact 120 may be able to withstand relatively high applied drilling forces because of a beneficial stress state and relatively high strength of mutual affixation between the superabrasive table 112 and substrate 110 provided by the interface 138. As discussed above, the superabrasive table 120 may comprise diamond (e.g, polycrystalline diamond), a diamond material (e.g., diamond formed by chemical vapor deposition, etc.), or any superabrasive material (e.g., cubic boron nitride, silicon carbide, etc.), as known in the art. Further, as discussed above, substrate 110 may be typically formed of a hard material, for instance, a cemented tungsten carbide or any other relatively hard material as known in the art.

Figure 20:
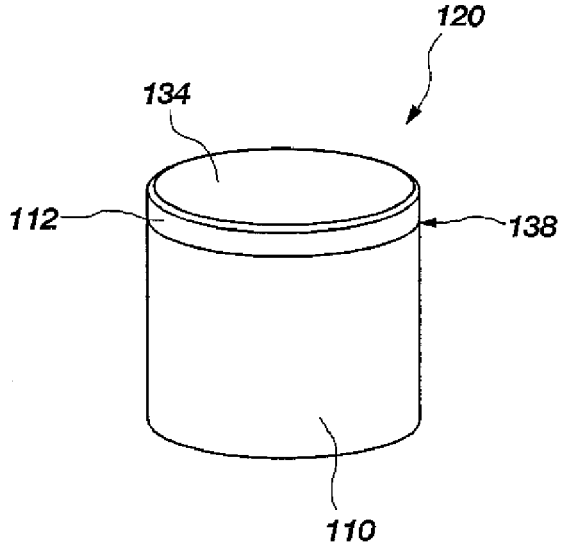
FIG. 20 shows a perspective view of a superabrasive compact including a substrate and a superabrasive table bonded to the substrate.

More generally, FIG. 20 shows a superabrasive compact 120 including a superabrasive table 112 exhibiting exposed surface 134, wherein the superabrasive table is bonded to a substrate 110 along interface 138. Thus, put another way, superabrasive table 112 may form a layer that at least partially (e.g. in one embodiment, completely) covers interfacial surface 130 of substrate 110. As discussed above, interface 138 may comprise a substrate interfacial surface (e.g., any substrate interfacial surface embodiment as discussed above in relation to FIGS. 1-19) and a generally complementary superabrasive table interfacial surface (e.g., an interfacial surface complementary to any substrate interfacial surface embodiment as discussed above in relation to FIGS. 1-19). Any of the embodiments encompassed by the above-discussion or variants encompassed thereby may be employed for forming superabrasive compact 120 as shown in FIG. 20.

Further, the present invention contemplates that, optionally, a catalyst (e.g., cobalt, nickel, iron, etc.) may be at least partially removed from a selected region of the superabrasive table 112. In one example, as mentioned above, superabrasive table 112 may comprise a polycrystalline diamond table. In one exemplary process, an acid may be used to leach at least a portion of the catalyst (e.g., cobalt, nickel, iron, etc.) from a selected region of the polycrystalline diamond table. As one of ordinary skill in the art will appreciate, any metals (e.g., tungsten) present within the polycrystalline diamond table or volume may be at least partially removed in combination with at least partial removal of the catalyst. The present invention further contemplates that electrolytic or electroless chemical processes, plating processes, or any other processes known in the art, without limitation, may be employed for removing at least a portion of a catalyst from a selected region of a polycrystalline diamond table, layer, or volume, without limitation.

Figure 21:
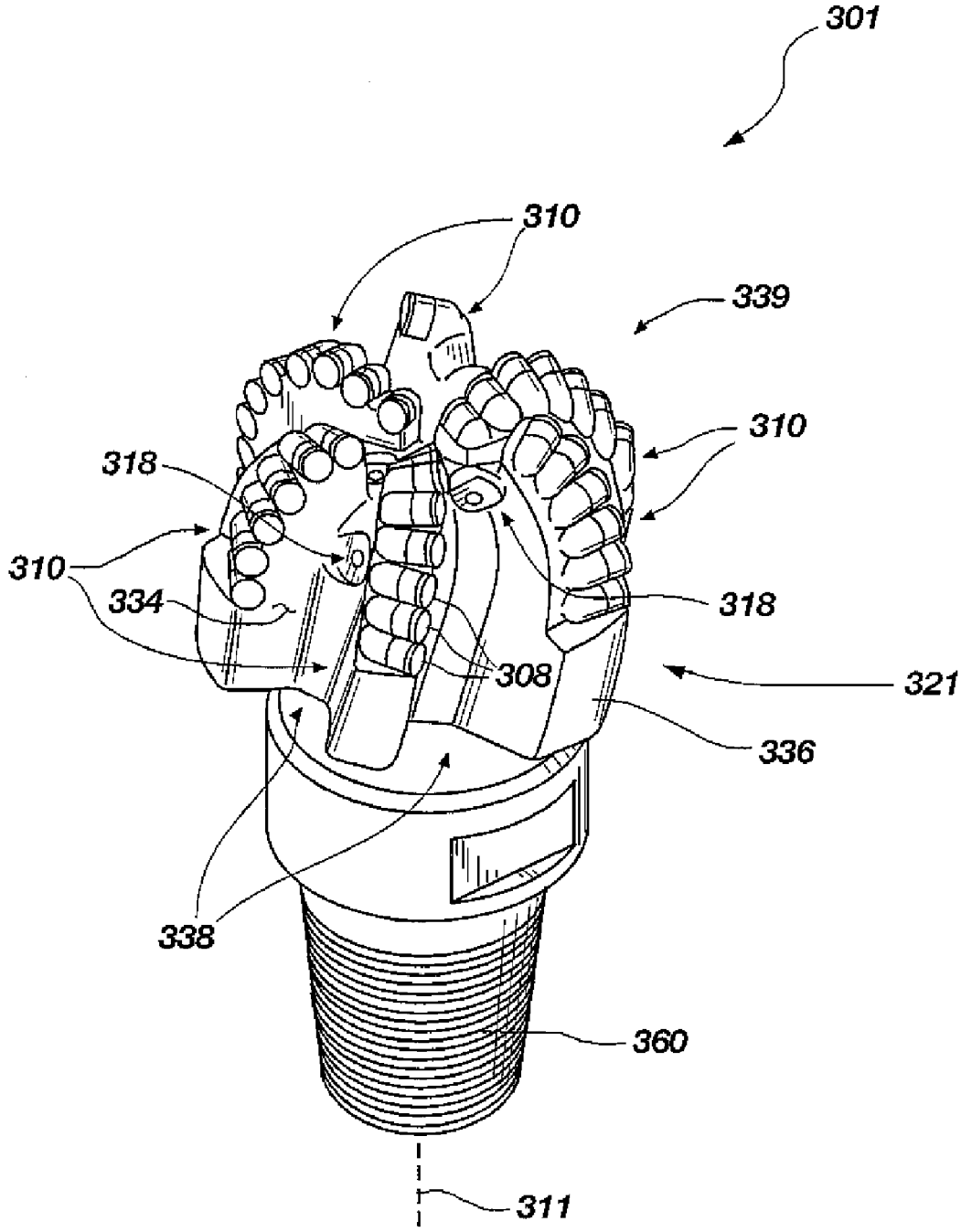
FIG. 21 shows a perspective view of a rotary drill bit including at least one superabrasive cutting element according to the present invention.
Figure 22:
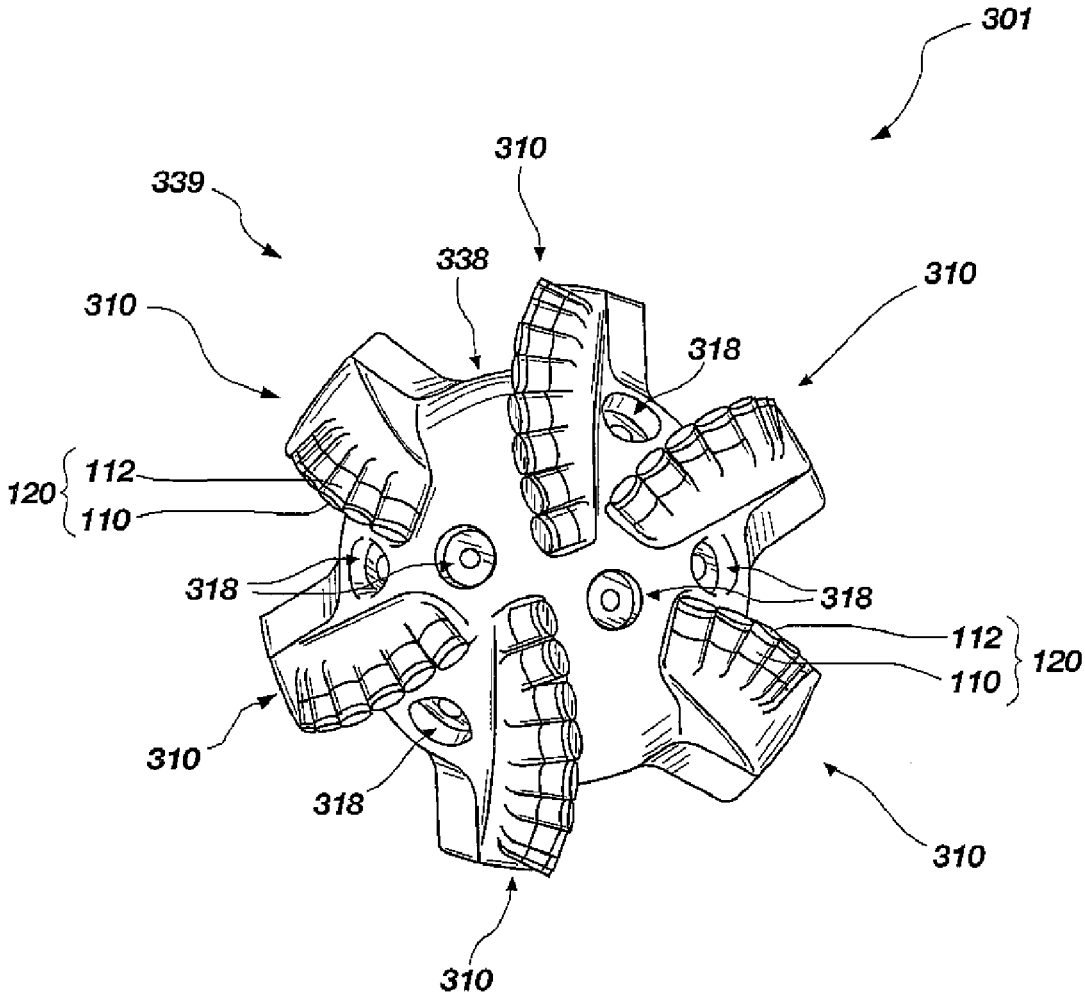
FIG. 22 shows a top elevation view of the rotary drill bit including at least one superabrasive cutting element according to the present invention as shown in FIG. 21.

Another aspect of the present invention contemplates that at least one superabrasive compact configured according to the above-described embodiments may be coupled to a rotary drill bit for forming a borehole into a subterranean formation. Put another way, a superabrasive compact according to the present invention may be employed as a cutting element for use on a subterranean drilling or boring tool. Such a configuration may provide a cutting element with enhanced impact resistance in comparison to a conventionally-configured cutting element. For example, FIGS. 21 and 22 show a perspective view and a top elevation view, respectively, of an example of an exemplary rotary drill bit 301 of the present invention including cutting elements 340 and 342 secured the bit body 321 of rotary drill bit 301. Generally, rotary drill bit 301 includes a bit body 321 which defines a leading end structure for drilling into a subterranean formation by rotation about longitudinal axis 311 and application of weight-on-bit, as known in the art. More particularly, rotary drill bit 301 may include radially and longitudinally extending blades 310 including leading faces 334. Further, circumferentially adjacent blades 310 define so-called junk slots 338 therebetween, as known in the art. As shown in FIGS. 21 and 22, rotary drill bit 301 may also include, optionally, cutting elements 120 (e.g., generally cylindrical cutting elements such as PDC cutters) which may be conventional, if desired. Additionally, rotary drill bit 301 includes nozzle cavities 318 for communicating drilling fluid from the interior of the rotary drill bit 301 to the cutting elements 120, face 339, and threaded pin connection 360 for connecting the rotary drill bit 301 to a drilling string, as known in the art.

Further, as shown in FIG. 22, at least one of cutting elements 120 may comprise a polycrystalline diamond table 112 formed upon a substrate 110. It should be understood that although rotary drill bit 301 includes at least one cutting element 120, the present invention is not limited by such an example. Rather, a rotary drill bit according to the present invention may include, without limitation, one or more cutting elements according to the present invention. Optionally, all of the cutting elements shown in FIGS. 21 and 22 may exhibit at least one embodiment contemplated by the present invention. Also, one of ordinary skill in the art will understand that FIGS. 21 and 22 merely depict one example of a rotary drill bit employing at least one cutting element 120 of the present invention, without limitation. More generally, the present invention contemplates that drill bit 301 may represent any number of earth-boring tools or drilling tools, including, for example, core bits, roller-cone bits, fixed-cutter bits, eccentric bits, bi-center bits, reamers, reamer wings, or any other downhole tool for forming or enlarging a borehole that includes at least one superabrasive cutting element, without limitation.

Although superabrasive cutting element and drilling tools described above have been discussed in the context of subterranean drilling equipment and applications, it should be understood that such systems are not limited to such use and could be used for varied applications as known in the art, without limitation. Thus, such superabrasive compacts are not limited to use with subterranean drilling systems and may be used in the context of any mechanical system including at least one superabrasive compact. In addition, while certain embodiments and details have been included herein for purposes of illustrating aspects of the instant disclosure, it will be apparent to those skilled in the art that various changes in the systems, apparatuses, and methods disclosed herein may be made without departing from the scope of the instant disclosure, which is defined, at least in part, in the appended claims. The words "including" and "having," (and respective variants) as used herein including the claims, shall have the same meaning as the word "comprising."

What is claimed is:

1. A superabrasive compact comprising:

a superabrasive table bonded to a substrate along an interface, the interface comprising:

a depression formed into the interface surface of the substrate, the depression surrounded by a peripheral wall, wherein the depression is formed over at least half of the cross-sectional area of the substrate interface surface;

a dividing wall positioned within the depression, the dividing wall forming at least one closed plane figure.

2. The superabrasive compact of claim 1, wherein the closed plane figure exhibits a shape selected from the group consisting of: generally square-shaped, generally circular, and generally triangular.

3. The superabrasive compact of claim 1, wherein an upper surface of the closed plane figure is substantially even with an upper surface of the peripheral wall.

4. The superabrasive compact of claim 1, wherein the superabrasive table comprises polycrystalline diamond and the substrate comprises tungsten carbide.

5. The superabrasive compact of claim 4, wherein a catalyst used for forming the polycrystalline diamond table is at least partially removed from at least a portion of polycrystalline diamond table.

6. The superabrasive compact of claim 1, further comprising at least one raised feature positioned generally within the depression.

7. The superabrasive compact of claim 6, wherein the at least one raised feature comprises four raised features, each of the four raised features comprising two leg sections.

8. The superabrasive compact of claim 7, wherein:
the closed plane figure is substantially square-shaped;
the four raised features are positioned in a circumferential pattern and are generally equidistantly from one another and as if rotated about a selected axis.

9. A superabrasive compact comprising:
a superabrasive table bonded to a substrate along an interface, the interface comprising:
a depression formed into the interface surface of the substrate, the depression surrounded by a peripheral wall, wherein the depression is formed over at least half of the cross-sectional area of the substrate interface surface;
a dividing wall positioned within the depression, the dividing wall forming at least one closed plane figure;
at least one raised feature positioned within the depression.

10. The superabrasive compact of claim 9, wherein the closed plane figure exhibits a shape selected from the group consisting of: generally square-shaped, generally circular, and generally triangular.

11. The superabrasive compact of claim 9, wherein an upper surface of the closed plane figure is substantially even with an upper surface of the peripheral wall.

12. The superabrasive compact of claim 9, wherein the superabrasive table comprises polycrystalline diamond and the substrate comprises tungsten carbide.

13. The superabrasive compact of claim 12, wherein a catalyst used for forming the polycrystalline diamond table is at least partially removed from at least a portion of polycrystalline diamond table.

14. The superabrasive compact of claim 9, wherein the at least one raised feature comprises four raised features, each of the four raised features comprising two leg sections.

15. The superabrasive compact of claim 14, wherein the two leg sections of each of the four raised features are substantially perpendicular to one another.

16. The superabrasive compact of claim 14, wherein:
the closed plane figure is substantially square-shaped;
the four raised features are positioned in a circumferential pattern and are generally equidistantly from one another as if rotated about a selected axis.

17. A superabrasive compact comprising:
a superabrasive table bonded to a substrate along an interface, the interface comprising:
a depression formed into the interface surface of the substrate, the depression surrounded by a closed peripheral wall, wherein the depression is formed over at least half of the cross-sectional area of the substrate interface surface;
the peripheral wall exhibits a thickness of about 0.080 inches or less.

18. The superabrasive compact of claim 17, further comprising a closed plane figure exhibiting a shape selected from the group consisting of: generally square-shaped, generally circular, and generally triangular.

19. The superabrasive compact of claim 17, wherein an upper surface of the closed plane figure is substantially even with an upper surface of the peripheral wall.

20. The superabrasive compact of claim 17, wherein the superabrasive table comprises polycrystalline diamond and the substrate comprises tungsten carbide.

21. The superabrasive compact of claim 20, wherein a catalyst used for forming the polycrystalline diamond table is at least partially removed from at least a portion of polycrystalline diamond table.

22. The superabrasive compact of claim 18, further comprising at least one raised feature positioned generally within the depression.

23. The superabrasive compact of claim 22, wherein the at least one raised feature comprises four raised features, each of the four raised features comprising two leg sections.

24. The superabrasive compact of claim 23, wherein the two leg sections of each of the four are substantially perpendicular to one another.

25. The superabrasive compact of claim 23 wherein:
the closed plane figure is substantially square-shaped;
the four raised features are positioned in a circumferential pattern and are generally equidistantly from one another as if rotated about a selected axis.

26. The superabrasive compact of claim 17, wherein the peripheral wall comprises a hexagonal peripheral wall and the depression comprises a hexagonal depression.

27. The superabrasive compact of claim 26, further comprising a plurality of inner hexagonal walls that define, in combination with the peripheral hexagonal wall, a hexagonal structure including a plurality of hexagonal recesses.

28. The superabrasive compact of claim 17, further comprising a plurality of substantially parallel elongated walls extending generally across the depression.

29. The superabrasive compact of claim 17, further comprising:
a circumferentially extending channel;
a first plurality of substantially parallel channels extending generally across the circumferentially extending channel, a second plurality of substantially parallel channels extending generally across the circumferentially extending channel.

30. A rotary drill bit for forming a borehole in a subterranean formation comprising:
a bit body;
at least one cutting element coupled to the bit body, the at least one cutting element comprising a substrate having a superabrasive layer of superabrasive material bonded to an interfacial surface of the substrate wherein an interface between the substrate and the superabrasive layer comprises:
a depression formed into the interface surface of the substrate, the depression surrounded by a peripheral wall, wherein the depression is formed over at least half of the cross-sectional area of the substrate interface surface;
a dividing wall positioned within the depression, the dividing wall forming at least one closed plane figure.

31. The superabrasive compact of claim 30, wherein the superabrasive table comprises polycrystalline diamond and the substrate comprises tungsten carbide.

32. The superabrasive compact of claim 31, wherein at least a portion of a catalyst used for forming the polycrystalline diamond table is at least partially removed from at least a portion of polycrystalline diamond table.

* * * * *